US008801528B1

(12) United States Patent
Dras

(10) Patent No.: US 8,801,528 B1
(45) Date of Patent: Aug. 12, 2014

(54) GOLF PRACTICE DEVICE

(76) Inventor: Ernest Dras, Maribor (SI)

( * ) Notice: Subject to any disclaimer, the term of this patent is extended or adjusted under 35 U.S.C. 154(b) by 63 days.

(21) Appl. No.: 13/601,255

(22) Filed: Aug. 31, 2012

(51) Int. Cl.
*A63B 69/36* (2006.01)

(52) U.S. Cl.
USPC ..... 473/147

(58) Field of Classification Search
USPC ..... 473/139–149, 257, 409
See application file for complete search history.

(56) References Cited

U.S. PATENT DOCUMENTS

| | | | | | |
|---|---|---|---|---|---|
| 2,929,632 | A | | 3/1960 | Moffatt | |
| 3,006,647 | A | * | 10/1961 | Haskett | 473/429 |
| 3,169,771 | A | * | 2/1965 | Holmes | 473/143 |
| 3,472,075 | A | | 10/1969 | Oppenheimer | |
| 3,837,654 | A | | 9/1974 | Hall | |
| 4,932,660 | A | | 6/1990 | Wang | |
| 5,255,920 | A | * | 10/1993 | Mangeri | 473/140 |
| 5,366,225 | A | | 11/1994 | Lazar | |
| 5,865,683 | A | * | 2/1999 | Yang | 473/147 |
| 6,086,488 | A | * | 7/2000 | Sanders | 473/423 |
| 6,257,989 | B1 | * | 7/2001 | Tortola et al. | 473/140 |
| 2002/0077188 | A1 | | 6/2002 | Anzaldua | |
| 2011/0306433 | A1 | * | 12/2011 | Brantingham | 473/140 |

OTHER PUBLICATIONS

Indoor /Outdoor Swing Groover Internet web site, http://foreverbettergolf.com/our-products/indoor-outdoor-swing-groover, last downloaded Aug. 21, 2012.

* cited by examiner

*Primary Examiner* — Nini Legesse

(57) ABSTRACT

One embodiment of a golf practice device comprising an upright support (12); a shaft (38) affixed to the upright support in a substantial horizontal orientation in predetermined height above a ground; a ball body (16) rotatably mounted to an outer end of the shaft; and a stopping member (14) attached to the upright support in a substantial horizontal orientation in position above the shaft. When a gold ball is struck by a golf club, it rotates about a horizontal axis and is stopped by the stopping member. The ball body is further slowed down by the unraveled cord (56) scratching the floor. After being hit with the full speed swing, the golf ball comes back into its initial quiet position in less than 5 seconds. Other embodiments are described.

10 Claims, 3 Drawing Sheets

GOLF PRACTICE DEVICE

CROSS-REFERENCE TO RELATED APPLICATIONS

Not Applicable

FEDERALLY SPONSORED RESEARCH

Not Applicable SEQUENCE LISTING OR PROGRAM
Not Applicable

BACKGROUND

1. Field

The present invention relates to an improved golf practice device. Practicing in accurate way with a suitable practice device is an important factor for a golf player to acquire proficiency.

2. Prior Art

A leading expert in the field of golf observed that millions of dollars annually spent on equipment does not seem to correspond to any improvement in the average handicap of golfers. This expert also noted that golf swing instruction is similarly unconnected to such improvement. The problem is that even with a golf swing that looks just perfect, a player may not have the point of impact under exact control. For example, even with a perceptively perfect swing, if a golfer misses the sweet spot by as little as 15 mm, the ball will change its direction and there will be less power delivered to the ball. The key to improving a golf handicap is training designed to improve precision in the point of impact such that the sweet spot on the golf club is consistently hit.

Learning golf is a step by step process. One should start with the shape of the swing, than work on solid impact—sweet spot precision, and finally strive for precision to the target. Training devices have been built to provide a means for practicing all the steps at once, however they were not satisfactory, except for settings that require a lot of space and costly high-tech technology.

My improved golf practice device focuses predominantly only on the first two steps of the golf training process, namely shape of the swing and precision at impact, and is optimized for this purpose. This makes it superior in relation to the prior art in this category of golf training devices.

For example, U.S. Pat. No. 2,929,632 which issued Mar. 22, 1960, entitled "Golf Practice Device", is a relatively simple exercising device including an elongate base as the artificial golf course; an L-shaped support projecting upwardly; a pulley which is rotatably mounted on the outer end portion of the horizontal section of support; a flexible cord on the pulley; a lightweight captive plastic ball, of perforated construction is supported on the lower end of the cord. The disadvantage of this device is that when the golf player hits the ball, it rotates around its axis for considerable time and has to be stopped by the golfer manually in order to bring it into initial position. This takes time and it distracts golfer's concentration. Another disadvantage is that it uses a lightweight plastic ball which does not give the player an authentic feel of a real golf ball at impact.

Further, U.S. Pat. No. 3,837,654 issued to Hall on Feb. 9, 1972, comprises a ball mounted on an arm which permits rotation of the ball when it is struck by a golf club. The arm includes a counting means and indicator for the projected distance the ball would travel. The arm also includes a braking means and an angular member. The latter has fingers remote from the arm which provide an indication as to whether or not the ball proceeded in the desired direction. The disadvantage is that the device includes complicated mechanism liable to be damaged when hitting the ball with full speed. Further disadvantage is that the ball rotates a number of times around its axis taking considerable time to reset itself into initial position.

A common failing in the prior art is that they include interruptions between player's practice strokes causing concentration loss, are not built strongly enough to facilitate full speed drives, and do not use a standard golf ball for authentic feel at impact. Thus, although the prior art has been in existence for many years, there is still no widely accepted practice device which enables a golf player to practice in a simple environment.

SUMMARY

In accordance with one embodiment a golf practice device comprises an upright support, a shaft mounted to the upright support in a substantial horizontal orientation, a ball member rotatably mounted to the outer end of the shaft, and a stopping member affixed to the upright support in a substantial horizontal orientation in position above the shaft. When a golf ball is being hit by the golf club, the ball rotates about the outer end of the shaft, is stopped by the stopping member and returns into its initial position.

DRAWINGS

Figures

The drawings and the preferred embodiments of the invention are presented with the understanding that the present invention is susceptible of embodiments in many different forms and, therefore, other embodiments may be utilized and structural, and operational changes may be made, without departing from the scope of the present invention.

REFERENCE NUMERALS

Figure 1:
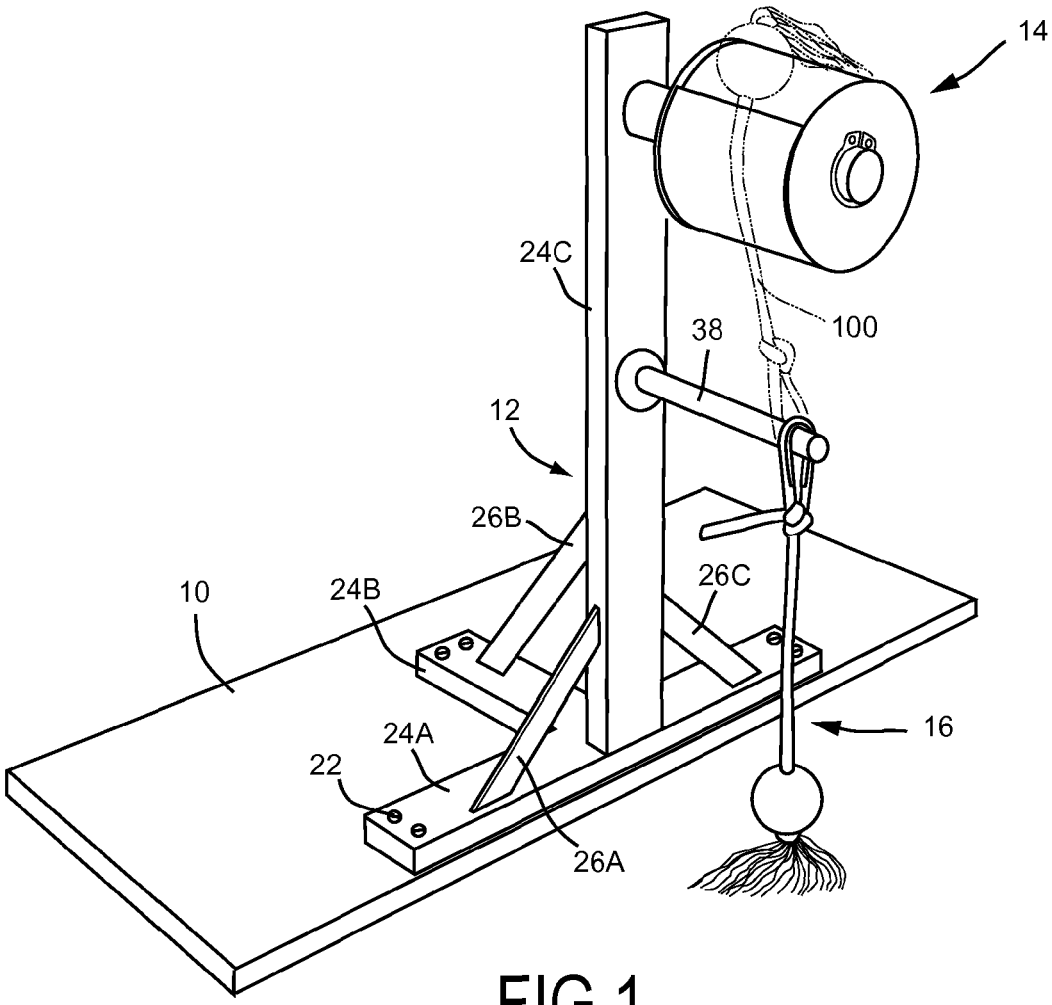
FIG. 1 is a perspective view of a golf practice device.
Figure 2:
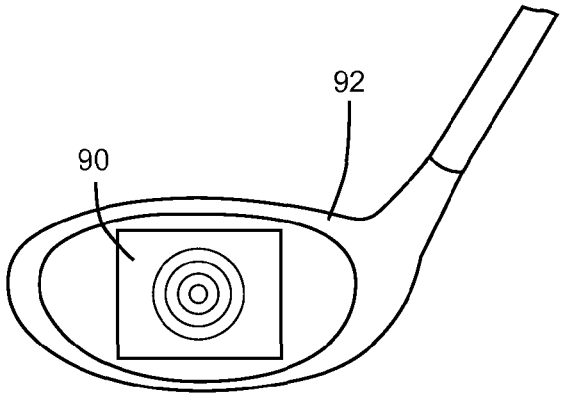
FIG. 2 shows an impact label attached to the golf club face.

10 base
12 upright support
14 stopping member
16 ball body
22 screw
24A rectangular tube
24B rectangular tube
24C rectangular tube
26A flat bar
26B flat bar
26C flat bar
28 nut
30 washer
32 hole
34 washer
36 threaded portion
38 shaft
40 groove

42 end portion
44 rope thimble
45 loop
46 bowline knot
48 cord
50 golf ball
52 tube
54 stop knot
56 unraveled cord
58 nut
60 washer
62 hole
64 washer
66 tube
68 circular groove
70 circular groove
72 seeger ring
74 plate
76 carpet roll
77 end portion of carpet stripe
78 plate
80 seeger ring
82 screw
90 impact label
92 golf club
100 ball stopped by member
166 tube—second embodiment
168 circular groove—s. embodiment
170 circular groove—s. embodiment
172 seeger ring—s. embodiment
176 cylinder with a hole

DETAILED DESCRIPTION

First Embodiment—FIGS. 1-5B

FIG. 1 shows a perspective view of one version of my device. It comprises a frame, or an upright support 12 that is mounted to a base 10. A shaft 38 is attached to the upright support 12 in a substantial horizontal orientation. A ball body 16 is rotatably mounted to the end portion of the shaft 38. A stopping member 14 is attached in substantial horizontal orientation to the upright support 12 in position above the shaft 38.

The base 10 is preferably made of wood and is configured to be removably affixed to a surface such that it does not move relative to the player upon the ball body being struck with a golf club 92. Any relatively immovable surface may be used, such as for example, the ground, a floor of a building or the deck of a ship. It may be removably affixed to the surface using any means common or convenient for such purpose, for example using double sided tape, glue, nails, clamps, or weights.

The upright support 12 is preferably welded together from rectangular tubes 24A, 24B, 24C, and flat bars 26A, 26B, 26C. Screws 22 are used at each leg of the upright support 12 to secure it to the base 10.

Figure 3:
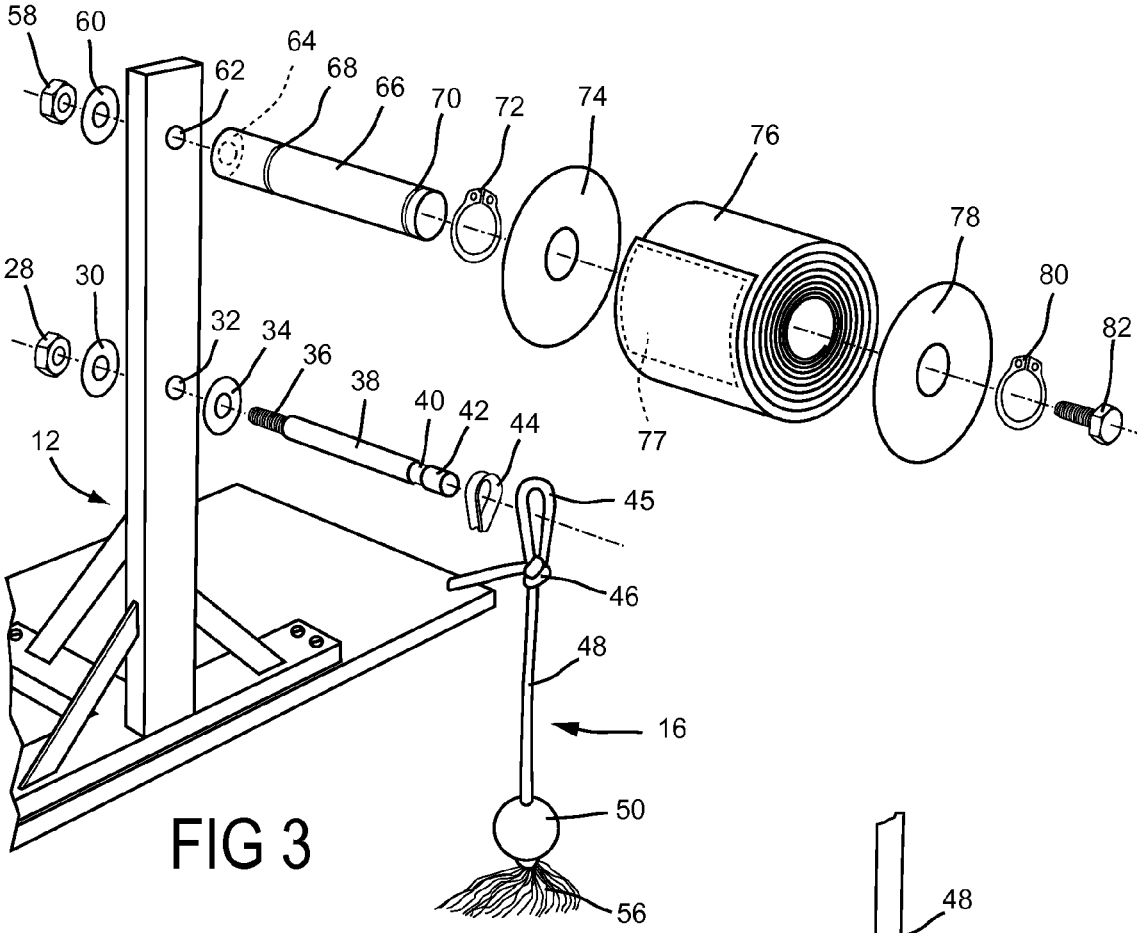
FIG. 3 shows an exploded perspective view of the device shown in FIG. 1.

Referring to FIG. 3, a threaded portion 36 at the inner end of the shaft 38 is placed through a washer 34 and a hole 32 and is secured into position with a washer 30 and a nut 28 placed on the other side of the upright support 12. At the outer end of the shaft 38 is a groove 40 for the placement of a rope thimble 44.

The ball body 16 is rotatably mounted to the outer end of the shaft 38. It comprises a rope, or a cord 48, a loop 45, the rope thimble 44, a bowline knot 46 (FIGS. 3 and 5B), a stop knot 54 (FIGS. 4 and 5A), a golf ball 50, and an unraveled cord 56 which is providing a braking function. The bowline knot 46 is used to create a loop 45 which is mounted to the rope thimble 44.

The diameter of the outer end of the shaft 42 is a little bigger than the inner diameter of the rope thimble 44; the two legs of the rope thimble 44 are slightly stretched apart so that it slides over the outer end of the shaft 42 and jumps into the groove 40 wherein it is locked and moves freely.

Figure 4:
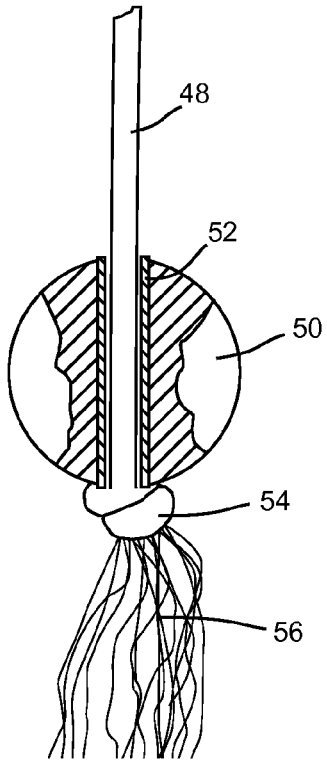
FIG. 4 is a cross section view of a golf ball.
Figure 5A:
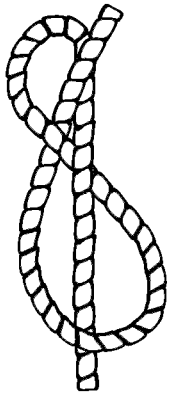
FIG. 5A shows a stop knot.
Figure 5B:
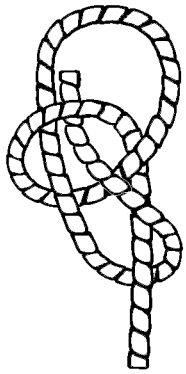
FIG. 5B shows a bowline knot.

The golf ball 50, as shown on FIG. 4, has a bore through its center big enough to accommodate a tube 52 that has a hole that allows passing of the cord 48. The tube 52 is preferably made of aluminum and increases the durability of the ball as it prevents the inner portion of the golf ball 50 from being squeezed when hit with the golf club. The stop knot 54 is placed below the golf ball 50 to prevent its sliding of the cord 48. Below the stop knot 54 is unraveled cord 56.

As further shown in FIG. 3, a washer 64 is welded to the inner end of a tube 66 which is mounted to the upright support 12 in a substantial horizontal orientation using a screw 82 that is placed through the hole of the washer 64 and a hole 62 and is secured into position with a washer 60 and a nut 58 placed on the other side of the upright support 12. The tube 66 has two circular grooves 68, 70 and a seeger ring 72 is placed into the circular groove 68 to stop a plate 74 from sliding further to the inner end of the tube 66. A carpet roll 76 is mounted to the tube 66. A plate 78 is locked into position by a seeger ring 80 that is placed into the circular groove 70. The carpet roll 76 is fixed into position by plates 74, 78 which prevent it to slide apart and move along the tube 66.

The carpet roll 76 is preferably made of a stripe of carpet that is rolled into a roll. The end portion of the carpet stripe 77 at the top of the roll is attached to the surface underneath using glue, rivets, or similar.

An impact label 90 (FIG. 2) is adhesively, removably attached to the golf club 92.

OPERATION

First Embodiment—FIGS. 1-4

In operation, this embodiment of my improved golf practice device is used in combination with the impact label 90 that is adhesively, removably attached to the golf club 92. Golf impact label is a product that is widely available on the market. When the golf ball 90 is being hit by the golf club 92, there will be an impression on the impact label 90 showing the precision of the stroke. The golf player should strive for impressions at the center of the impact label 90 representing the sweet spot of the club face.

After the golf ball 50 is being hit by the golf club 92, the ball body 16 rotates about the outer end of the shaft 38 for half a circle and is stopped by the stopping member 14. The ball body 16 being stopped by the stopping member 14 is shown in FIG. 1 as an alternate position of the ball body 100. The stopping member 14 is placed above the shaft 38 and allows the use of the device by a left handed and a right handed player without any adjustment. The most of the power is taken away from the golf ball 50 when it hits the stopping member 14 and it bounces back toward the initial position where the ball body 16 is again slowed down by the braking function of the unraveled cord 56 that scratches the ground. The ball body 16 swings back and forward until it finally stops and the golf ball 50 is ready for being hit again. Depending on the texture of the floor, the ball body 16, after being hit with the full speed swing, comes back into its initial position in about 4 to 7 seconds. If for example the floor is artificial grass, it takes less than 5 seconds; if the surface is smooth, it takes less than 7 seconds for the ball body 16 to stop moving.

The height of the golf ball 50 relative to the ground can be accommodated by loosening the bowline knot 64 and in this way adjusting the length of the cord between the golf ball 50 and the bowline knot 64. This is easily done as the bowline knot has a characteristic that it can be easily untied even after being tied very strongly.

Figure 6:
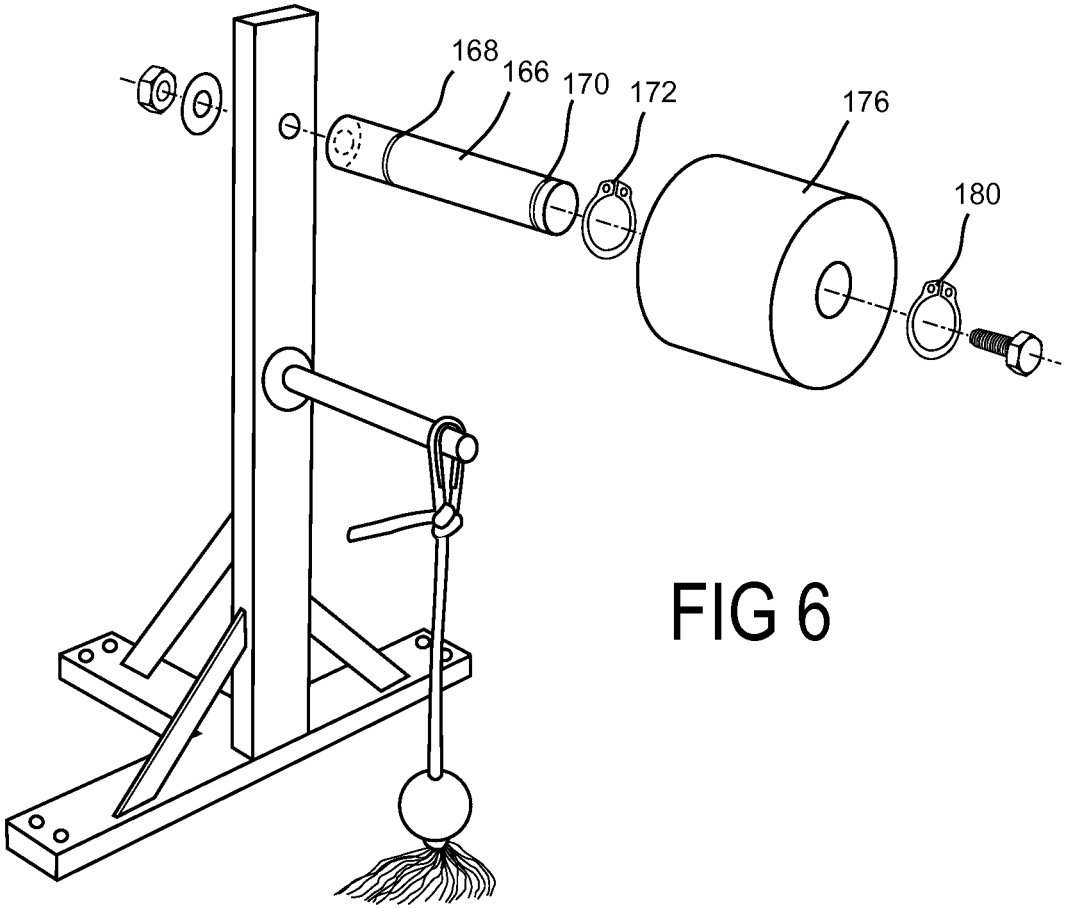
FIG. 6 is a perspective partly exploded view of a second embodiment of the device.

Second Embodiment—FIG. 6

One difference in relation to the first embodiment is that here the stopping member 14 (FIG. 1) is simplified. As shown in FIG. 6, a tube 166 is mounted to the upright support 12 in the same way as the tube 66 in the first embodiment. The tube 166 has two circular grooves 168, 170, and two seeger rings 172, 180 are placed into circular grooves 168, 170 respectively to lock a cylinder with a hole 176 into its position after being mounted to the tube 166. I presently contemplate for this embodiment that the cylinder with the hole 176 have a circular cross section 110 mm and be 10 cm long and made of rubber. However it can have different cross sections, such as oval, triangular, square, rectangular, etc., and be made of different sizes and materials such as foam, plastic, etc. Instead of using seeger rings, the cylinder with the hole 176 can be locked on the tube 166 in many different ways, for example by being glued to the tube, secured with clamps, etc. The tube 166 can have different cross sections, such as oval, triangular, square, rectangular, etc.

Another difference in relation to the first embodiment is that here the device is mounted to the floor in a manner that no base (for example wooden plate) is used. That means that the upright support is mounted directly to the floor. It may be removably affixed to the surface using any means common or convenient for such purpose, for example using double sided tape, glue, nails, screws, or clamps. At present I believe that this embodiment is most efficient, but the other embodiments are also satisfactory.

Operation of the second embodiment is the same as in the first embodiment so there is no need to repeat it.

Advantages

My improved golf practice device is embodying a golf ball that is so movably supported as to always return to a driving position after it is hit whereby the device may be utilized to develop skill in striking a golf ball, especially acquiring proficiency in striking a golf ball with the optimal point of impact—sweet spot. The golfer does not want any distractions between golf strokes and my device is satisfying this demand. After he or she hits the golf ball, it will return to its initial quiet position in about 4 to 7 seconds, depending on the surface of the floor, and be ready to be hit again.

Another advantage of this embodiment of my device is that it is built so strongly that a standard golf ball can be used, and it will endure even the full speed drives performed by long drive competitors. The majority of golfers prefer to use a standard golf ball when practicing, as they deem the feel experienced at impact delivered by a standard golf ball as very important.

Further advantage of this embodiment of my device is that it can be used by a left handed and a right handed golfers without any adjustment to the device.

Yet another object is to provide a device which, by a minor modification thereto, permits use thereof either indoors or any solid flat surface such as a floor, sidewalk, or the like, as well as outdoors.

A still further object of this embodiment of my improved golf practice device is to furnish a device of the character described that requires a minimum of space in which to set it up and use, is simple in construction, efficient and reliable in performance, can be fabricated from standard, commercially available materials, requires a minimum of maintenance, and can be marketed at a sufficiently low price as to encourage the widespread use thereof.

CONCLUSION, RAMIFICATIONS, AND SCOPE

Accordingly the reader will see that, according to one embodiment of the invention, I have provided a golf practice device that is strongly built, is not unnecessarily interrupting the golfer between swings, is using a standard golf ball for correct sound and feel at impact, and is easy to manufacture. While the above description contains many specificities, these should not be construed as limitations on the scope of any embodiment, but as exemplifications of the presently preferred embodiments thereof. Many other ramifications and variations are possible within the teachings of the various embodiments.

For example:

- different types of golf ball can be used instead of a standard golf ball, such as glow golf ball, or other non-standard variations of practice balls;
- next, other materials can be used to provide the braking function of the unraveled cord below the golf ball, such as stripes of textile, etc;
- in one embodiment, the frame or the upright support is welded together from rectangular tubes and flat bars, however the parts can be of different shapes, circular, oval, square, etc., and can be assembled in different way, for example by using flanges, clamps, etc;

Thus the scope of the invention should be determined by the appended claims and their legal equivalents, and not by the examples given.

The invention claimed is:

1. A golf practice device comprising:

a. a shaft, b. first mounting means for securing said shaft in a substantial horizontal orientation in predetermined height above a ground, c. a ball body rotatably mounted to an end portion of said shaft, d. a braking member attached below a golf ball, e. second means for stopping said golf ball affixed to said first mounting means in substantial horizontal orientation in predetermined height above said shaft, whereby said golf ball, after being hit by a golf club, rotates about said outer end of said shaft, is stopped by said second means for stopping said golf ball, and whereby said braking member is scratching the ground and thereby braking the movement of said golf ball until it stops in its initial position.

2. The golf practice device of claim 1 wherein said first mounting means is an upright support.

3. The golf practice device of claim 2 wherein said upright support comprises a plurality of assembled elongated members.

4. The golf practice device of claim 1 wherein said ball body rotatable about the outer end of said shaft comprises a flexible cord and said golf ball.

5. The golf practice device of claim 1 wherein said braking means is an unraveled cord whereby said unraveled cord scratches said ground and slows down a back and forth movement of said golf ball.

6. The golf training device of claim 1 wherein said second means for stopping said golf ball comprises a cylinder made of shock absorbing material.

7. A method for practicing golf swing comprising:

a. providing an upright support, b. providing a shaft mounted to said upright support in substantial horizontal orientation in predetermined height above a ground, c. providing a ball body rotatably mounted to an end portion of said shaft, d. providing a stopping member affixed to said upright support in substantial horizontal orientation in predetermined position above said shaft, e. providing a braking member attached below said golf ball, f. providing a golf club, g. swinging said golf club and hitting a golf ball, whereby a golf ball, after being hit by said golf club, rotates about said outer end of said shaft, is stopped by said stopping member, is further slowed down by said braking member, and returns into its initial position, allowing a golfer to practice swings without interruptions.

8. A golf practice device comprising:

a. an upright support, b. a shaft mounted to said upright support in substantial horizontal orientation in predetermined height above a ground, c. a ball body rotatably mounted to an end portion of said shaft, d. a braking member attached to a golf ball at its underside, whereby said golf ball, after being hit by a golf club, rotates about said outer end of said shaft, and whereby said braking member is scratching the ground and thereby braking the movement of said golf ball until it stops in its initial position.

9. The golf practice device of claim 8 wherein said braking member is an unraveled cord.

10. The golf practice device of claim 8 further including a base as a mounting means for said upright support.

* * * * *